US012691368B2

(12) United States Patent
Labonté

(10) Patent No.: US 12,691,368 B2
(45) Date of Patent: Jul. 28, 2026

(54) TABLETOP SHOOTING GAME

(71) Applicant: Dave Labonté, Victoriaville (CA)

(72) Inventor: Dave Labonté, Victoriaville (CA)

( * ) Notice: Subject to any disclaimer, the term of this patent is extended or adjusted under 35 U.S.C. 154(b) by 217 days.

(21) Appl. No.: 18/181,817

(22) Filed: Mar. 10, 2023

(65) Prior Publication Data

US 2023/0293977 A1 Sep. 21, 2023

(30) Foreign Application Priority Data

Mar. 15, 2022 (GB) ..... 2203566

(51) Int. Cl.
*A63F 7/06* (2006.01)
*A63F 7/24* (2006.01)
*A63F 7/30* (2006.01)

(52) U.S. Cl.
CPC ..... *A63F 7/0632* (2013.01); *A63F 7/2481* (2013.01); *A63F 7/305* (2013.01); *A63F 7/249* (2013.01); *A63F 2007/3005* (2013.01)

(58) Field of Classification Search
CPC ..... A63F 7/0632; A63F 7/305; A63F 7/2481; A63F 7/06; A63F 7/2472; A63F 2007/3005; A63F 7/00; A63F 7/249
USPC ..... 273/108–108.56, 129 R, 129 V, 129 W; 124/36
See application file for complete search history.

(56) References Cited

U.S. PATENT DOCUMENTS 470,691 A * 3/1892 Meem ..... A63F 7/2472 273/129 R
497,607 A * 5/1893 Riggs ..... A01M 27/00 43/84
512,104 A * 1/1894 Fishel ..... A63F 7/0017 273/119 R
529,802 A * 11/1894 Olsson ..... A63F 7/0017 273/119 R
1,385,677 A * 7/1921 Gillette ..... A63F 7/0005 273/129 R
1,598,214 A * 8/1926 Milewski ..... A63F 7/249 273/119 R
1,650,935 A * 11/1927 Cox ..... A63F 7/305 273/352
1,658,054 A 2/1928 Levy
(Continued)

FOREIGN PATENT DOCUMENTS

DE 102014224672 10/2020
GB 191103063 11/1911
(Continued)

OTHER PUBLICATIONS

Translation and original of DE 102014224672 A1, titled "Hockey Toy Arrangement", by inventor Stephan Manthei, pp. 1-15, published Jun. 2, 2016. (Year: 2016).*
(Continued)

*Primary Examiner* — Sebastiano Passaniti

(57) ABSTRACT

A tabletop shooting game, comprising: a projectile, a target and a shooter, the shooter including a stand defining a resting surface for receiving the projectile thereonto, an impactor and a biasing element for biasing the impactor towards the resting surface. The shooter is operable for shooting the projectile towards the target by moving the impactor to a loading position away from the resting surface with the projectile resting on the resting surface and subsequently releasing the impactor.

17 Claims, 7 Drawing Sheets

(56) References Cited

U.S. PATENT DOCUMENTS 1,859,220 A * 5/1932 Richards ..... A63F 7/382 273/119 R
1,954,838 A * 4/1934 Woolsey ..... A63F 7/06 473/439
2,114,777 A * 4/1938 Englerth ..... A63F 7/0612 273/355
2,192,096 A * 2/1940 Minger ..... A63F 7/0612 273/399
2,432,824 A * 12/1947 Shetler ..... A63B 65/12 124/16
2,482,437 A * 9/1949 Richards ..... A63F 7/2472 124/16
2,841,398 A * 7/1958 Conner ..... A63F 7/06 273/127 R
3,140,093 A * 7/1964 Singer ..... A63F 7/06 473/41
3,190,653 A 6/1965 Karthaus
3,329,433 A * 7/1967 Ryan ..... A63F 7/00 473/109
3,525,320 A 8/1970 Dekan
3,610,623 A * 10/1971 Ferrer ..... A63F 9/02 273/355
3,785,648 A * 1/1974 Kobayashi ..... A63F 7/068 273/443
3,794,318 A 2/1974 Holmes
3,865,377 A * 2/1975 Cooper ..... A63F 7/0005 273/127 D
3,884,472 A * 5/1975 Meyer ..... A63F 7/025 273/127 D
3,887,181 A 6/1975 Samaras
3,888,485 A * 6/1975 Conti ..... A63F 7/2472 273/317.5
3,899,173 A * 8/1975 Zaris ..... A63F 7/0612 273/405
3,940,135 A * 2/1976 Cohen ..... A63F 7/068 273/443
3,970,306 A * 7/1976 Smith, Jr. ..... A63F 7/06 273/317.1
3,995,859 A * 12/1976 Goldfarb ..... A63F 7/0652 273/129 R
4,067,575 A 1/1978 Ayer
4,078,800 A 3/1978 Goldfarb et al.
4,183,533 A * 1/1980 Kulesza ..... A63B 65/12 124/36
4,213,612 A * 7/1980 Wildman ..... A63F 9/02 273/357
4,261,577 A * 4/1981 Ellis ..... A63F 7/249 273/357
4,279,419 A 7/1981 Barnes
5,069,460 A * 12/1991 Kulesza ..... A63F 7/06 273/355
5,449,171 A 9/1995 Makhoulian
5,765,832 A 6/1998 Huff
5,851,012 A * 12/1998 Langieri, Jr. ..... A63F 7/0612 273/317.1
6,089,568 A * 7/2000 Milici ..... A63F 3/00041 273/298
6,477,933 B1 * 11/2002 McNulty, Jr. ..... F41H 13/0025 124/20.3
6,581,931 B1 * 6/2003 Doepner ..... A63F 7/26 273/287
6,634,954 B1 * 10/2003 Diaw ..... A63D 3/00 273/129 S
7,740,246 B1 * 6/2010 Walterscheid ..... A63F 7/0628 273/348.5
D771,757 S 11/2016 Reuter
10,213,670 B2 2/2019 Adams
2003/0116912 A1 * 6/2003 Bangerter ..... A63F 7/06 273/108.1
2008/0303213 A1 * 12/2008 Bowman ..... A63F 7/06 273/247
2018/0071605 A1 3/2018 Freedman et al.
2023/0125772 A1 * 4/2023 McDonough ..... A63F 7/2427 273/119 R

FOREIGN PATENT DOCUMENTS

GB 334313 9/1930
GB 2200298 8/1988
GB 225659 12/1992

OTHER PUBLICATIONS

WO 2007/014430, identified with a title of "Game Apparatus", and an inventor named Peter William Schofield, pp. 1-19, published Feb. 8, 2007. (Year: 2007).*

* cited by examiner

TABLETOP SHOOTING GAME

FIELD OF THE INVENTION

The present invention relates to the general field of games, and is more particularly concerned with a tabletop shooting game, for example simulating the sport of hockey.

BACKGROUND

There are many tabletop games used to simulate various sport. One such type of games represents the sport of hockey. Typically, such games generally comprise a model hockey ring or surface, at least one actuatable model hockey player, and at least one actuatable model hockey goaltender protecting a goal net.

The at least one model hockey player can be user selectively actuated by a game participant so as to hit a model hockey puck towards a predetermined location in the goal net, all the while trying to avoid other model hockey player(s), obstacle(s), and/or the goaltender in the line of view towards the predetermined location in the goal net.

Other tabletop games apparatus are adapted to replicate other types of individual or team sports involving a ball such as, for examples, soccer, baseball, basketball, American football, golf and tennis, among others. These other types of tabletop games are based on a similar assembly of one or more actuatable model players and goals positioned on a tabletop game surface, ring or course.

Such tabletop games are generally limited in the way and/or precision with which a game participant can actuate a model game player so as to hit or throw the model puck or ball toward a predetermined target. For example, actuatable model game players in these known tabletop games are generally limited in the manner in which they are capable of hitting or throwing a model puck or ball.

For instance, hockey and soccer tabletop games generally allow a participant to actuate a model game player so as to hit the model puck or ball in a substantially horizontal straight path towards the goal or target. Some limited lob effects on the model puck or ball can sometimes be achieved with a powerful hit or swing, but the resulting path is generally unpredictable, imprecise and may often end out of the tabletop game surface. Typically, the model game player must be positioned at a sufficient distance away from the desired target in order for the puck or ball to rise sufficiently above the game surface to avoid an obstacle in the line of view, which is not always possible due to the size of the tabletop game surface, or allowed by the game rules.

In other instances of tabletop games, such as basketball, tennis or golf games, the upward pitch angle at which the model ball is hit or thrown is generally static. Thus, for varying the height and distance covered by a lob effect impinged to the ball is generally achieved through varying the position of the model game player on the tabletop game surface, and the power at which the ball is hit or thrown towards the basket or golf hole. This removes a lot of realism from the game, as skilled players of the real life sport can control independently their position and both the angle and force used to propel the puck or ball.

Thus, there is a need on the market for an improved tabletop shooting game. An object of the present invention is therefore to provides such a game.

SUMMARY OF THE INVENTION

In a broad aspect, there is provided a tabletop shooting game, comprising: a projectile; a shooter including a stand, an impactor and a biasing element, wherein; the stand defines a resting surface for receiving the projectile thereonto; the impactor defines an impact surface for contacting the projectile when the projectile is on the resting surface, the impactor being rotatably mounted to the stand so as to be movable between a hitting position wherein the impactor is in register with the resting surface and a loading position wherein the impactor is retracted away from the resting surface; and the biasing element extends between the stand and the impactor so that the impactor is biased towards the hitting position when moved in the loading position; and a target. The shooter is operable for shooting the projectile towards the target by moving the impactor to the loading position with the projectile on the resting surface and subsequently releasing the impactor so that the impact surface projects the projectile.

There may also be provided a tabletop shooting game wherein the stand includes a first portion positionable on a support surface and a second portion mounted to the first portion, the impactor being rotatably mounted to the second portion, the second portion being mounted to the first portion so as to be pivotable thereabout to vary a pitch of the second portion relative to the first portion.

There may also be provided a tabletop shooting game wherein the shooter further includes a pitch indicator extending between the first and second portions, the pitch indicator including indicia indicative of the pitch.

There may also be provided a tabletop shooting game wherein the shooter further includes another biasing element extending between the first and second portions for biasing the second portion towards a predetermined pitch relative to the first portion.

There may also be provided a tabletop shooting game wherein the stand defines a pair of laterally opposed resting surfaces for selectively receiving the projectile thereonto, and wherein the impactor is movable between a pair of loading positions for selectively loading the impactor prior to hitting the latter with the projectile with the projectile resting on a respective one of the resting surfaces.

There may also be provided a tabletop shooting game wherein the impactor defines two laterally opposed biasing element attachments, the biasing element having a free end selectively securable to each of the biasing element attachments for biasing the impactor towards the hitting position when in a respective one of the loading positions.

There may also be provided a tabletop shooting game wherein the target defines at least one target aperture configured and sized to allow the projectile to enter the target aperture.

There may also be provided a tabletop shooting game wherein the target includes a resiliently deformable material behind the target apertures for absorbing at least part of a kinetic energy of the projectile after the projectile enters the target apertures.

There may also be provided a tabletop shooting game wherein the target defines at least two target apertures configured and sized to allow the projectile to selectively enter each of the target apertures, the target further comprising a screen configured for selectively obstructing a first subset of the at least two target apertures while leaving unobstructed a second subset of the at least two target apertures.

There may also be provided a tabletop shooting game wherein the screen includes a disk from which one or more portion has been removed, the disk being rotatable about a substantially horizontal axis, wherein rotating the disks changes a composition of the first and second subsets.

There may also be provided a tabletop shooting game wherein the tabletop shooting game simulates hockey.

There may also be provided a tabletop shooting game further comprising a board on which the shooter and target are positionable.

There may also be provided a tabletop shooting game wherein the board defines a shooter positioning area over which the shooter is selectively movable.

There may also be provided a tabletop shooting game wherein the shooter positioning area is recessed relative to adjacent portions of the board.

There may also be provided a tabletop shooting game wherein the shooter and tabletop are magnetically attracted to each other over the shooter positioning area.

There may also be provided a tabletop shooting game further comprising obstacles positionable between the shooter and the target.

There may also be provided a tabletop shooting game further comprising a turntable onto which the obstacles are positionable, wherein rotating the turntable changes a relative position between the obstacles and the target.

There may also be provided a tabletop shooting game further comprising game cards including instructions for providing selective restrictions on how the shooter and target are operated in a given round of the tabletop shooting game.

In another broad aspect, there is provided a method of playing a tabletop shooting game including a game board, a shooter, a projectile and a target defining at least one target aperture, the method comprising: positioning the shooter and the target on the game board; positioning the projectile on a resting surface part of the shooter; retracting an impactor part of the shooter away from the projectile against a biasing force exerted by a biasing element; and releasing the impactor so that the impactor hits the projectile.

There may also be provided a method further comprising adjusting a pitch of the resting surface relative to the game board prior to releasing the impactor.

Advantageously, the proposed game improves the realism with which the shooting game can be played, while remaining in some embodiments relatively cost-effective to manufacture. Also, the addition of the pitch degree of freedom provides a greater challenge to the player to master, which potentially makes the game more interesting to some categories of players.

Other objects, advantages and features of the present invention will become more apparent upon reading of the following non-restrictive description of some embodiments thereof, given by way of example only with reference to the accompanying drawings.

The present invention claims priority from UK patent application GB2203566.1 filed Mar. 15, 2022, the contents of which is hereby incorporated by reference in its entirety.

DETAILED DESCRIPTION

The terms "substantially" and "about" are used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. Also, directional terminology, such as "top", is used with reference to a typical use of the proposed game in a level orientation on a horizontal table. This terminology is used for convenience and should not be used to unduly restrict the scope of the present invention.

Figure 20:
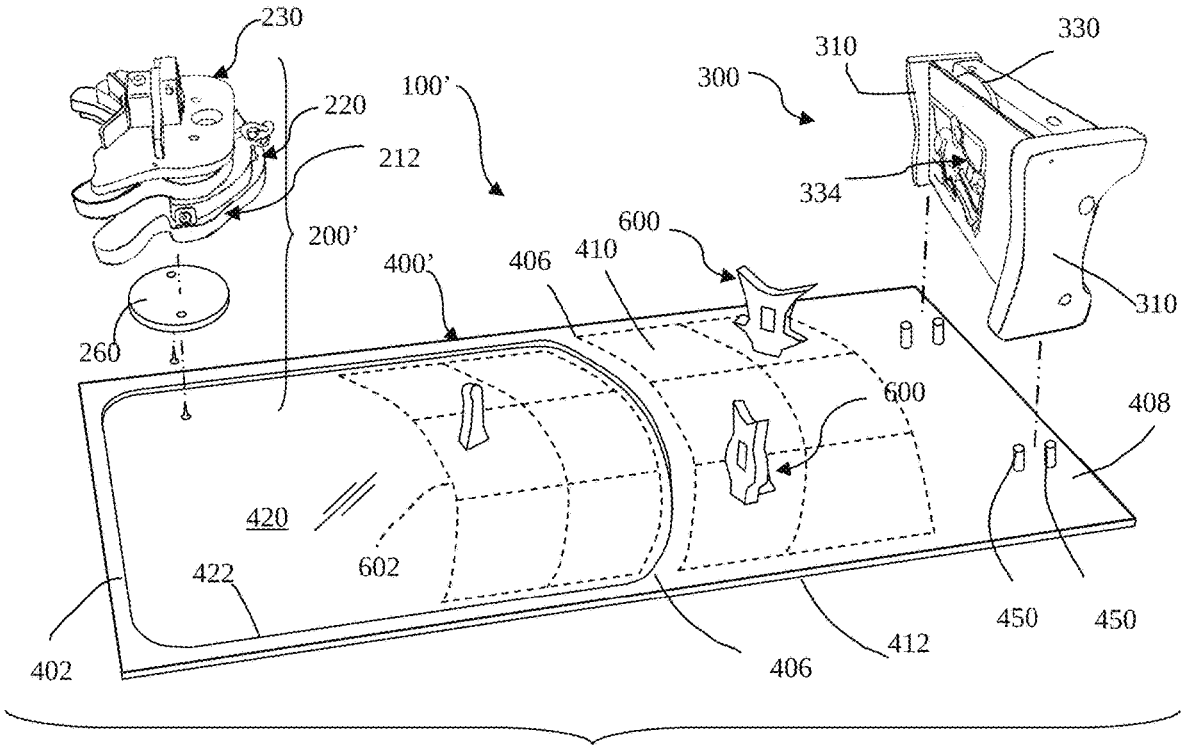
FIG. 20, in a top perspective view, illustrates an other embodiment of a tabletop hockey game apparatus, according to the present invention.

FIGS. 1 to 19, and 21, illustrate various aspects of a first embodiment, according to the present invention, of a tabletop shooting game. While the tabletop shooting game shown in the drawings is embodied as a tabletop hockey game apparatus 100 usable with a projectile in the form of a model hockey puck 500 having a disk shaped configuration, similar tabletop shooting gamed could simulate sports other then hockey, for example, and non-limitingly, soccer. FIGS. 20 and 22 illustrates other embodiments, according to the present invention, of tabletop hockey game apparatuses 100' and 100" that are closely similar to the first embodiment. The tabletop hockey game apparatus 100 comprises a user selectively actuatable shooter in the form of a model hockey player 200 and a target in the form of a model hockey goal 300.

Figure 2:
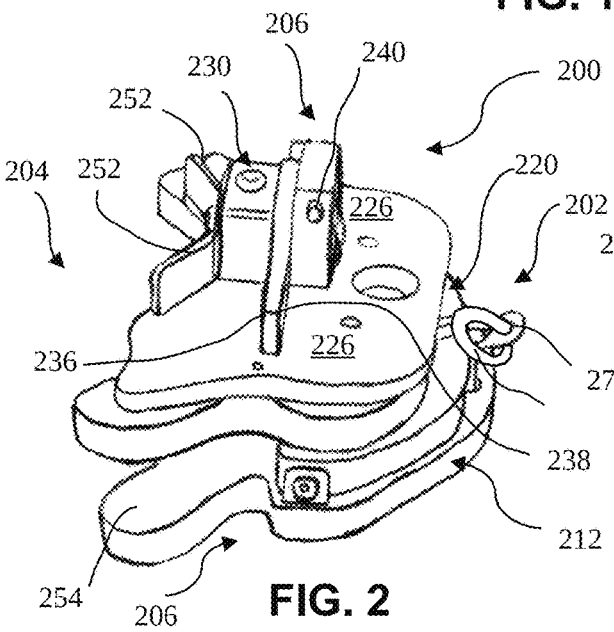
FIG. 2, in a right side perspective view, illustrates a model hockey player part of the game of FIG. 1.
Figure 3:
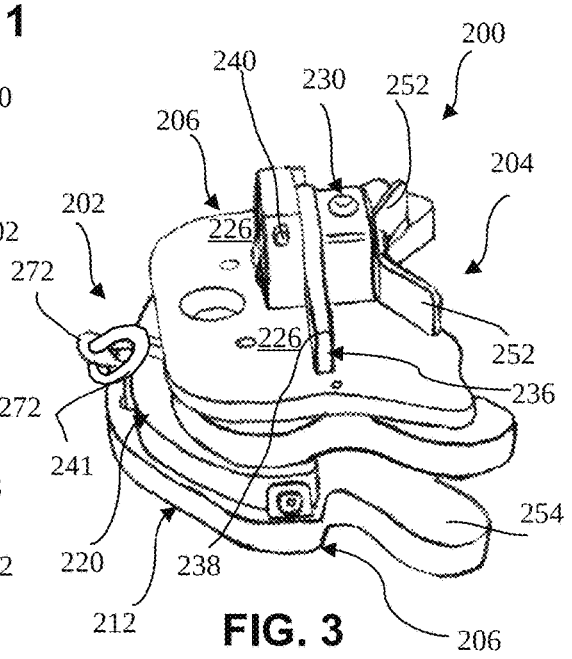
FIG. 3, in a left side perspective view, illustrates the model hockey player of FIG. 2.
Figure 4:
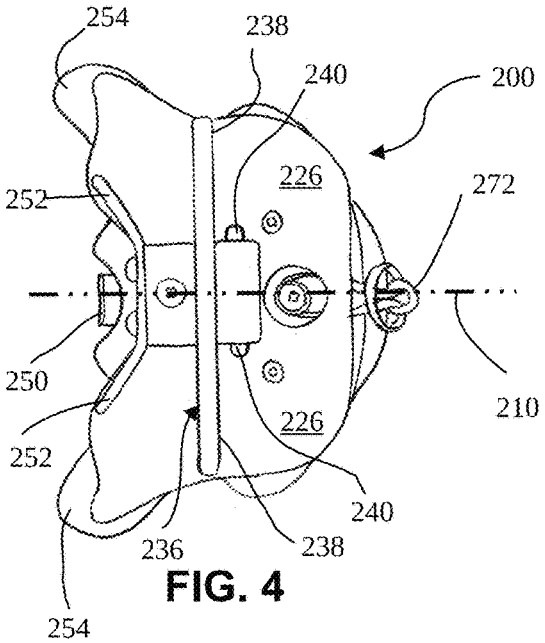
FIG. 4, in a top plan view, illustrates the model hockey player of FIG. 2, here shown having a player top component component in a first position.

Referring to FIGS. 2 to 10 collectively, the model hockey player 200 defines a player forward portion 202, a player rearward portion 204, and laterally opposed player lateral portions 206. The model hockey player 200 defines an imaginary model player longitudinal axis 210, as illustrated in FIG. 4. The model player longitudinal axis 210 extends longitudinally centrally between the player rearward portion 204 and the player forward portion 202.

The model hockey player 200 includes a player base component 212. The player base component 212 includes a base component bottom portion 214. The base component bottom portion 214 is sized and configured for stably and slidably engaging a top surface portion of a tabletop game board 400 (shown for example in FIG. 1), and a base component upper portion 216. For example, the base component bottom portion 214 defines a substantially flat surface for resting on the tabletop game board 400.

The model hockey player 200 further includes a player middle component 220. The player middle component 220 includes a middle component lower portion 222. The middle component lower portion 222 is pivotably mounted on the base component upper portion 216 along a laterally extending axis to allow the player middle component 220 to vary its pitch relative to the player base component 212.

The player middle component 220 further includes a middle component upper portion 224. The middle component upper portion 224 defines at least one, and in some embodiments, as shown, a pair of resting surfaces 226. Each one in the pair of resting surfaces 226 is located in an equidistantly laterally spaced apart relationship on each side of the model player longitudinal axis 210, and is parallel relative to the tabletop game board 400 when the player middle component 220 also extends substantially parallelly relative to the tabletop game board 400. The resting surfaces 226 are configured for receiving the projectile, for example the model hockey puck 500. In the embodiment shown in the drawings, the resting surfaces 226 are substantially flat. However, if a ball-shaped projectile is used, for example to model a soccer game, the resting surface 226 may be provided with a slightly recessed portion (not shown in the drawings) to receive the ball without the latter rolling easily off the resting surface 226. Although the player middle component 220 is illustrated in the figures by an assembly of stacked planar elements, it is to be understood that it can be represented by a one piece molded component or any other suitable assembly.

Figure 6:
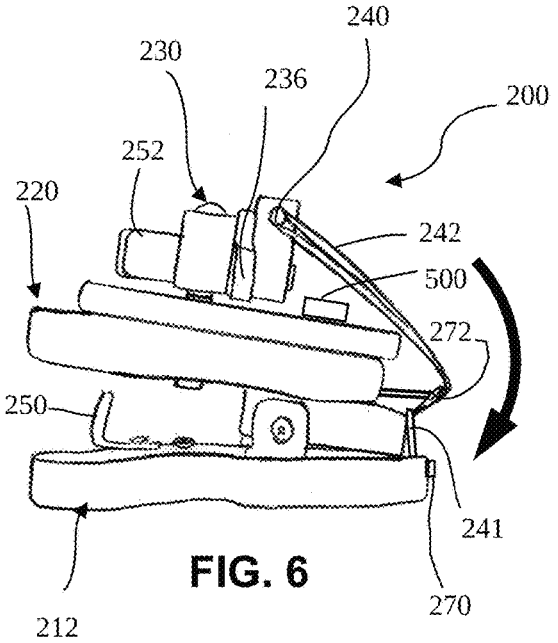
FIG. 6, in a right side elevational view, illustrates the model hockey player of FIG. 2, here shown having a player middle component pivoted forwardly.
Figure 7:
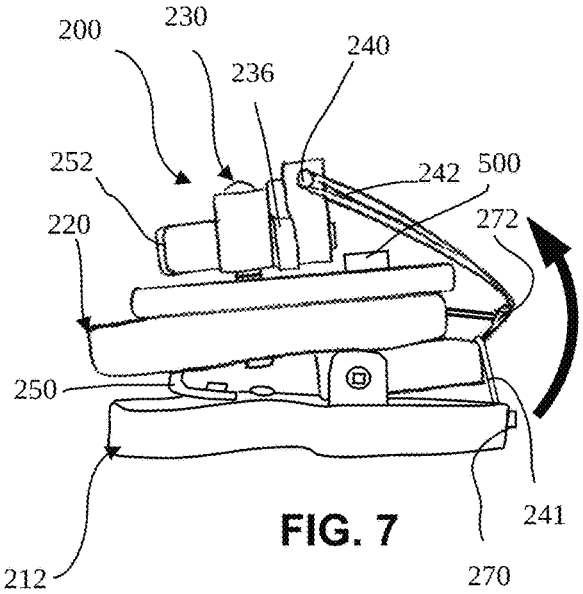
FIG. 7, in a right side elevational view, illustrates the model hockey player of FIG. 2, here shown having the player middle component pivoted rearwardly.

The player middle component 220 is at least slightly pivotably movable between a middle component rearward position, seen in FIG. 7, wherein the player middle component 220 is at least slightly pivoted rearwardly, with the resting surface 226 sloping upwardly in a direction leasing towards the player forward portion 202, a middle component forward position, seen in FIG. 6, wherein the player middle component 220 is at least slightly pivoted forwardly, with the resting surface 226 sloping downwardly in a direction leasing towards the player forward portion 202, and a middle component intermediate position, seen for example in FIG. 3, wherein the player middle component 220 is located between the middle component rearward position and the middle component forward position, with the resting surface 226 substantially parallel to the base component bottom portion 214.

The model hockey player 200 further includes a player top component 230. The player top component 230 is substantially smaller than the player middle component 220 as seen from in a top plan view and acts as an impactor for impacting the projectile, for example the model hockey puck 500, to propel the latter in the air, for example towards the model hockey goal 300. The player top component 230 includes a top component lower portion 232. The top component lower portion 232 is rotably mounted on the middle component upper portion 224 about an axis of rotation extending centrally perpendicularly upwardly relative to the pair of resting surfaces 226. The player top component 230 further includes a top component upper portion 234. The player base and middle components 212 and 220 form a stand for supporting the player top component 230.

Figure 9:
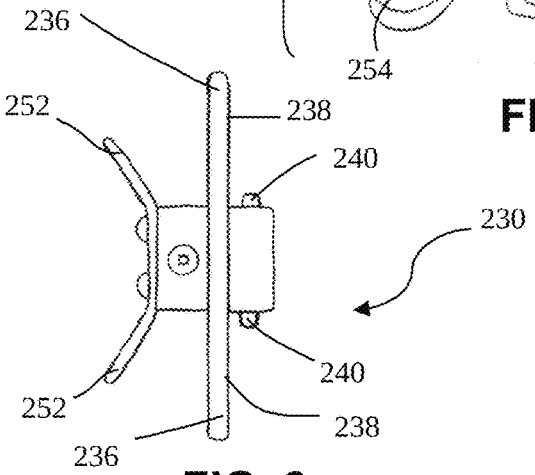
FIG. 9, in a top plan view, illustrates the player top component.
Figure 10:
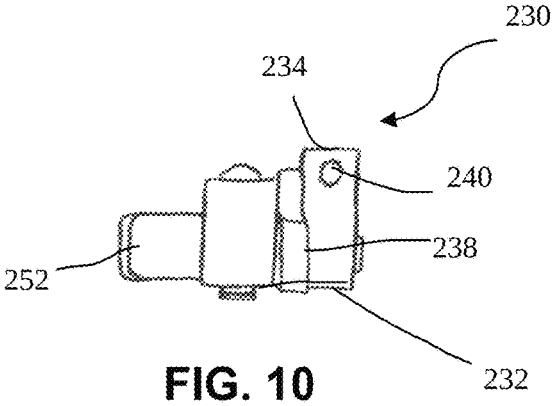
FIG. 10, in a right side elevational view, illustrate the player top component of FIG. 9.

As best illustrated in FIG. 9, the player top component 230 further includes a pair of hockey puck impacting blades 236. Each one in the pair of hockey puck impacting blades 236 has a generally elongated plate like configuration extending laterally opposed from each other at a respective lateral side of the rotatable player top component 230. Each one in the pair of hockey puck impacting blades 236 further has a lower longitudinal edge extending substantially parallelly proximally relative to a respective resting surface 226 of the middle component upper portion 224, and defines a planar blade impacting surface 238 oriented substantially forwardly relative to the model hockey player 200 when the player top component 230 is oriented centrally forwardly.

The player top component 230 further includes a pair of elastic engaging members 240. Each one in the pair of elastic engaging members 240 extends laterally away relative to one another from a respective lateral side of the player top component 230. Each one in the pair of elastic engaging members 240 is further located a point above a respective hockey puck impacting blade 236, and proximally the axis of rotation of the player top component 230.

Figure 5:
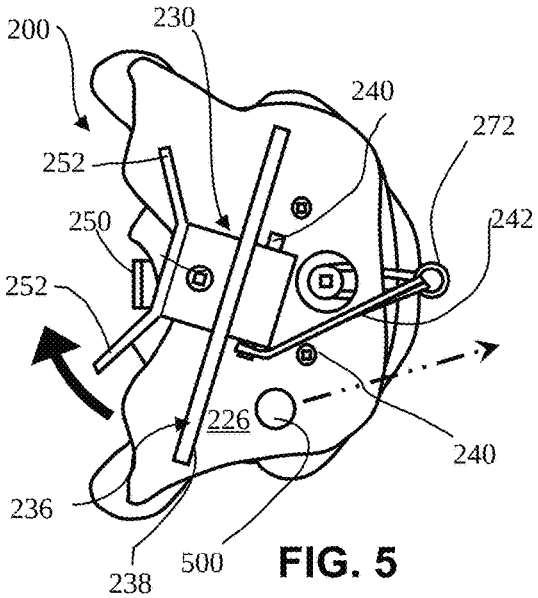
FIG. 5, in a top plan view, illustrates the hockey player unit of FIG. 2, here shown having player top component pivoted in a leftward position.

Furthermore, the player top component 230 is rotatable between a top component first loading position, seen in FIG. 5, wherein one of the hockey puck impacting blades 236 has its free end positioned away and rearwardly relative to one of the resting surfaces 226, and a top component second loading position, not shown in the drawings, wherein the other, opposite, hockey puck impacting blades 236 has its free end positioned away and rearwardly relative to the other one of the resting surfaces 226. Therefore, the top component first and second loading positions are mirror image from each other. Thus, the player top component 230 is rotatably mounted to the stand so as to be movable between a hitting position, shown in FIG. 4 for example, wherein the hockey puck impacting blades 236 are in register with the resting surface and two loading positions, wherein a respective one of the puck impacting blades 236 is retracted away from a respective resting surface 226, as seen for example in FIG. 5.

Referring to FIGS. 4 to 8 inclusively, and 21, the model hockey player 200 further includes a first elastic element 241. The first elastic element 241 has two opposed end portions thereof mounted respectively between a forward central portion of the player base component 212, and a forward central portion of the player middle component 220. The first elastic element 241 is suitably configured and sized for pivotally biasing forwardly the pivotable player middle component 220 towards towards a predetermined pitch relative to the player base component 212, for example towards the middle component forward position.

The model hockey player 200 further includes a second elastic element 242. The second elastic element 242 has two opposed end portions thereof connected respectively between a forward central portion of the player middle component 220, and a user selected one in the pair of elastic engaging members 240 of the player top component 230. The second elastic element 242 is suitably configured and sized for rotably biasing the rotatable player top component 230 towards the opposed position of the player top component 230 relative to the selected elastic engaging member 240. The player top component 230 is therefore biased towards the hitting position when moved in the loading position on the side of the player top component to which the second elastic element is engaged. In the embodiments shown in the drawings, two loading positions are achievable by the player top component 230, each corresponding to loading of the player top component 230 to hit a projectile on a respective one of the resting surfaces 226. However, in alternative embodiments, only of of the loading position is achievable.

Although first and second elastic elements 241 and 242 are used in the embodiment shown in the drawings, in alternative embodiments, biasing of the various components of the model hockey player 200 relative to each other towards each other can be achieved using other types of biasing element, such as for example and non-limitingly, coil springs.

Figure 13:
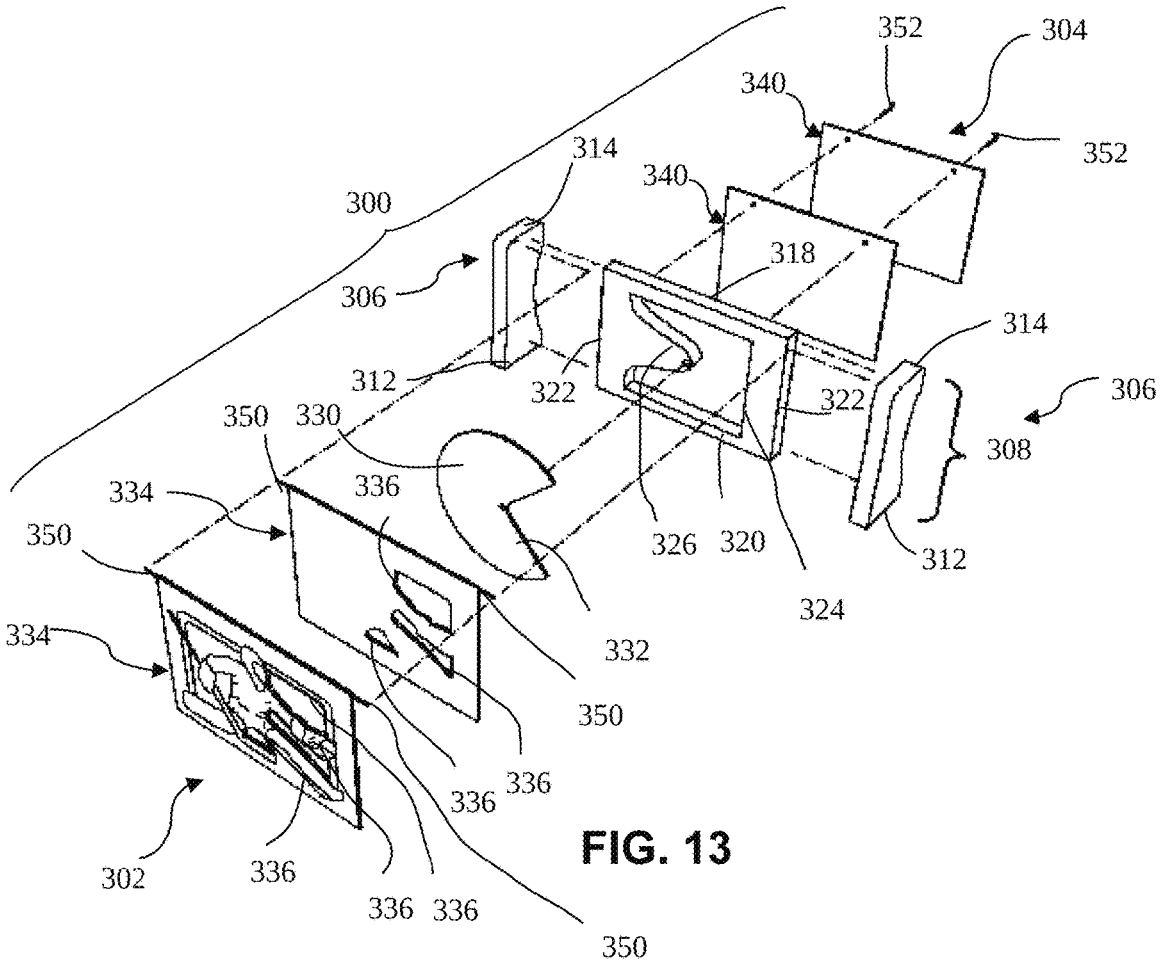
FIG. 13, in a front perspective, exploded view, illustrate the model hockey goal of FIG. 11.
Figure 14:
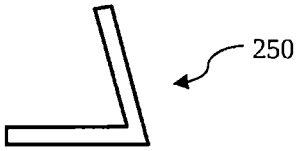
FIG. 14, in a side elevational view, illustrate a pitch indicator.
Figure 15:
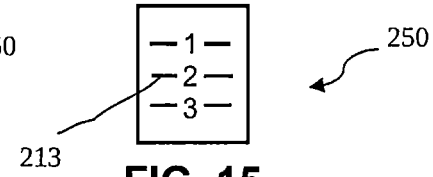
FIG. 15, in a front elevational view, illustrate the pitch indicator of FIG. 14.
Figure 16:
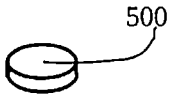
FIG. 16, in a perspective view, illustrate a model hockey puck.
Figure 17:
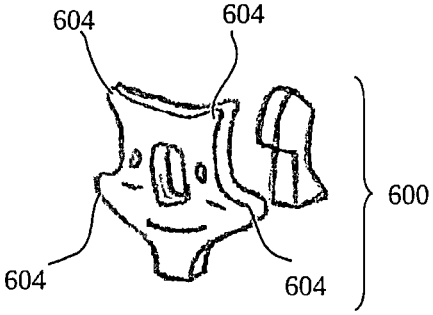
FIG. 17, in a front perspective, exploded view, illustrate an embodiment of a game board obstacle.
Figure 18:
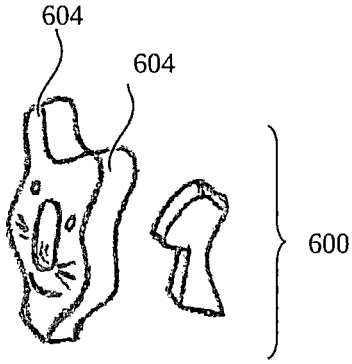
FIG. 18, in a front perspective, exploded view, illustrate an other embodiment of a game board obstacle.
Figure 19:
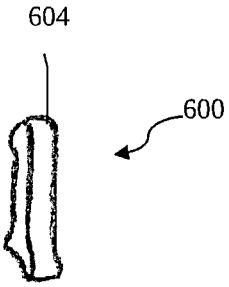
FIG. 19, in a front perspective view, illustrate yet an other embodiment of a game board obstacle.

The tabletop hockey game apparatus 100 further comprises the model hockey goal 300. Referring now more particularly to FIGS. 1 and 11 to 15 collectively, the model hockey goal 300 includes a goal front end 302, a goal rear end 304, and distally opposed goal lateral sides 306. As best illustrated in FIG. 13, the model hockey goal 300 further includes a goal support frame 308.

The goal support frame 308 includes a pair of frame support members 310. Each one in the pair of frame support members 310 has a generally elongated configuration extending vertically and in a parallelly spaced apart relationship relative to one another, and includes a support member base portion 312 suitably sized and shaped for stably engaging a top surface portion of the tabletop game board 400. Each one in the pair of frame support members 310 further has a support member upper portion 314 extending upwardly from the support member base portion 312.

The model hockey goal 300 further includes a frame plate element 316. The frame plate element 316 has a generally rectangular plate like configuration extending horizontally laterally, and vertically edgewise, and is defined by a pair of plate parallel upper and lower horizontal edges 318 and 320 respectively, and laterally opposed and vertically extending plate lateral side edges 322. The frame plate element 316 joins together the pair of frame support members 310 along its plate vertically extending lateral side edges 322.

The frame plate element 316 further defines a frame plate element opening 324 extending substantially adjacently along the whole peripheral edge of the frame plate element 316, and a disk support arm 326 extending from an inner peripheral edge of the frame plate element opening 324 to a central location relative to the frame plate element 316.

Still referring to FIG. 13, the model hockey goal 300 further includes a rotatable disk 330. The rotatable disk 330 is rotably mounted about an axis extending horizontally forwardly from the disk support arm 326 of the frame plate element 316 such that the rotatable disk 330 is centrally and proximally parallely located relative to the front side of the frame plate element 316. The rotatable disk 330 has a sufficient diameter such that an upper peripheral edge portion of the rotatable disk 330 is at least slightly protruding above the upper horizontal edge 318 of the frame plate element 316, so as to be user selectively rotatable using the tip of a finger.

One or more portions of the rotatable disk 330 are removed from the ideal disk shape. For example, the rotatable disk 330 defines at least one disk recess 332. Each one of the at least one disk recess 332 extends from a peripheral portion of the rotatable disk 330 and radially inwardly relative therefrom, and is sufficiently sized and shaped for freely receiving there through the model hockey puck 500. In the embodiment shown in the drawings, there is one disk recess 332 taking the form of a sector of the rotatable disk 330.

The model hockey goal 300 further includes at least one front plate element 334. Each one of the at least one front plate element 334 is located in a parallelly and substantially proximally and parallely spaced apart relationship relative to one another and to the front side of the rotatable disk 330. Each one of the at least one front plate element 334 is freely suspended along an upper horizontal edge thereof from a laterally extending upper forward portion of the goal support frame 308, has a rectangular configuration sufficiently sized to substantially cover the whole front side of the frame plate element 316, and defines at least one front plate aperture 336, for example three front plate apertures 336 as shown in the drawings. Each one of the at least one front plate apertures 336 extends through the respective front plate element 334, is located in a spaced apart relationship relative to one another on a respective front plate element 334, and is sufficiently sized and shaped for freely receiving there through the model hockey puck 500. Furthermore, each one of the at least one front plate aperture 336 is suitably located along the respective front plate element 334 so as to be capable of being wholly in register with at least one of the at least one disk recess 332, when the rotatable disk 330 is rotated so as to be suitably in register therewith. Thus, the disk 330 defines a screen configured for selectively obstructing a first subset of the front plate apertures 336 while leaving unobstructed a second subset of the front plate apertures 336. Rotating the disk 330 changes a composition of the first and second subsets by changing the front plate apertures 336 that are respectively obstructed and unobstructed. While a screen in the form of a rotatable disk 336 with a removed sector is exemplified in the drawings, other types of screens are usable in alternative embodiments, such as a plate that is slidable along the model hockey goal 300, among other possibilities.

The model hockey goal 300 further includes at least one rear plate element 340. Each one of the at least one rear plate element 340 is located in a parallelly and substantially proximally spaced apart relationship relative to one another and to the rear side of the frame plate element 316. Furthermore, each one of the at least one rear plate element 340 is freely suspended along an upper horizontal edge thereof from an upper rearward portion of the goal support frame 308, and has a rectangular configuration sufficiently sized to substantially cover the whole rear side of the frame plate element 316.

Figure 1:
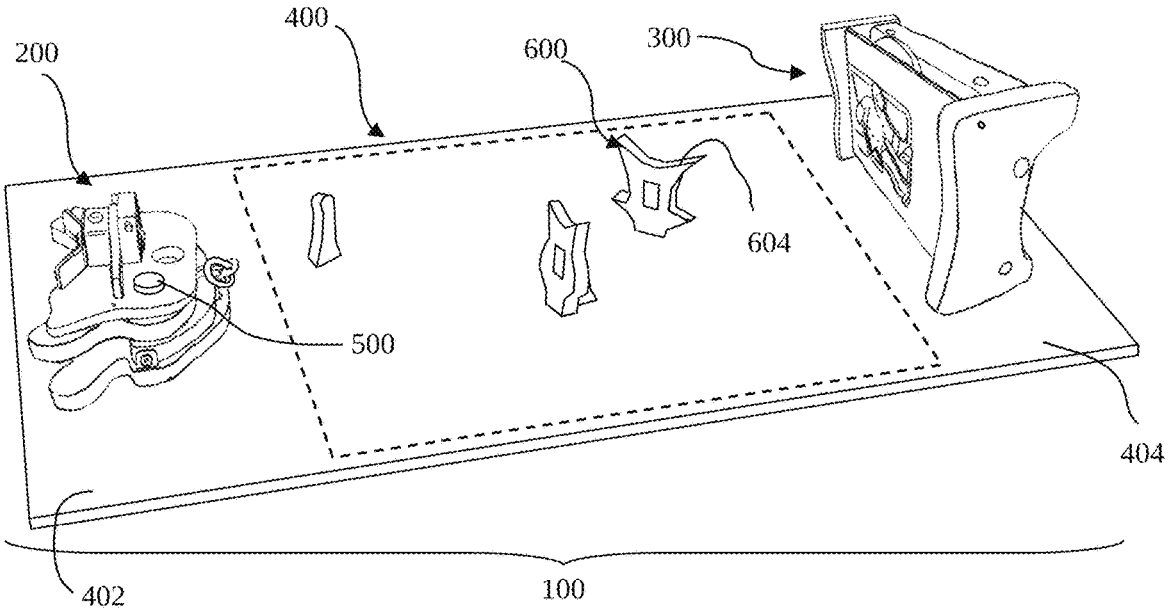
FIG. 1, in a perspective view, illustrates an embodiment of a tabletop shooting game according to the present invention, embodied as a hockey game apparatus.

Referring now more particularly to FIGS. 1 and 20, to use the model hockey player 200, the latter is typically positioned on a proximal end surface portion of the game board 400 relative to the user, and oriented to face generally towards the other longitudinal end of the game board 400. The user may then position the model hockey puck 500 flat on a user selected one of the resting surfaces 226 of the player middle component 220 such that it is substantially proximally located in front of the corresponding hockey puck impacting blade 236.

The user may then engage a portion of the second elastic element 242 on a user selected one of the elastic engaging members 240 of the player top component 230, and then at least slightly rotate and hold the player top component 230 towards the top component leftward or rightward position thereof corresponding to the side on which is located the model hockey puck 500, such that the proximal hockey puck impacting blade 236 is distanced at least slightly rearwardly away from the model hockey puck 500.

The user may then cooperatively adjust both the forward alignment of the player base component 212 and the rearward to forward pitch of the player middle component 220 in order to aim, for example, a user selected one of the front plate element apertures 336 of the model hockey goal 300, or any other user selected target. Finally, the user may then release the rotatable player top component 230 such that the model hockey puck 500 is hit by the hockey puck impacting blade 236 and projected substantially forwardly in a user selected direction and rearward to forward pitch angle toward the desired frame plate element opening 324 or any other user selected target. Therefore, the proposed model hockey player 200 allows an intended user to control 4 degrees of freedom relating to the model hockey player before the model hockey puck 500 is hit, namely, two degrees of freedom related to the position of the model hockey player 200 on the generally planar surface of the tabletop game board 400, along with the yaw and pitch of the resting surfaces 226 relative to the same planar surface of the tabletop game board 400.

To use the model hockey goal 300, the latter is typically positioned on an end of the tabletop game board 400 opposed to the model hockey player 200, and typically facing generally towards an intended user operating the model hockey player 200. The user may then rotate the rotatable disk 330 of the model hockey goal 300 such that a user selected one of the at least one disk recess 332 is in register with a user selected one of the front plate element apertures 336. Subsequently, the user may typically use the model hockey player 200 to aim and shoot the model hockey puck 500 through the user selected frame plate element opening 334.

Typically, as illustrated in FIGS. 1 and 20, both the model hockey player 200 and the model hockey goal 300 are spaced apart and substantially facing one another at opposed longitudinal ends of the game board 400, with the model hockey player 200 being slidably movable along its end surface portion of the game board 400, and the model hockey goal 300 removably connected to the surface of the game board 400 through model goal engaging pins 450 extending upwardly from a centered game board surface portion, and compatibly shaped engaging holes (not shown in the figure) underside the frame support members 310 of the model hockey goal 300.

Thus, competing users of the tabletop hockey game apparatus 100 can, each in turn, position the rotatable disk 330 of the model hockey goal 300 and the model hockey player 200 on the game board 400 according to game instructions given, for example, on random draw game cards 405, and operate the model hockey player 200 in an attempt to throw the model hockey puck 500 through one of the aligned openings between the front plate element 336 and the rotatable disk 330 of the model hockey goal 300. The game cards 405 provide selective restrictions on how the model hockey player 200 and model hockey goal 300 are operated in a given round of the tabletop shooting game. Also, the proposed apparatus 100 may be operated in free play mode, in which an intended user simply shoots the model hockey puck 500 as he wishes to practice his precision.

Referring to FIGS. 6, 7, 8, 14 and 15 collectively, and also, in some embodiments of the invention, the model hockey player 200 further includes a pitch indicator 250 for providing a visual indication to the user of the rearward to forward pitch of the player middle component 220 relative to the player base component 212, for example using indicia 213. Thus, after a failed attempt to score the model hockey puck 500 into a selected opening of the model hockey goal 300, the user may have a reference pitch measurement on which to base subsequent trials.

As illustrated for example in FIGS. 2, 5, 8 and 9, in some embodiments of the invention, the player top component 230 further includes a pair of thumb handle members 252. Each one in the pair of thumb handle members 252 has a generally elongated configuration extending laterally and oppositely away relative to one another from a respective lateral side of the player top component 230, and is located adjacently rearwardly to a respective one of the hockey puck impacting blades 236. Thus, the user may rotate angularly the player top component 230 with relatively higher precision and comfort using the appropriate thumb handle member 252 conveniently located behind each hockey puck impacting blades 236 using a pinching action between two fingers.

Figure 8:
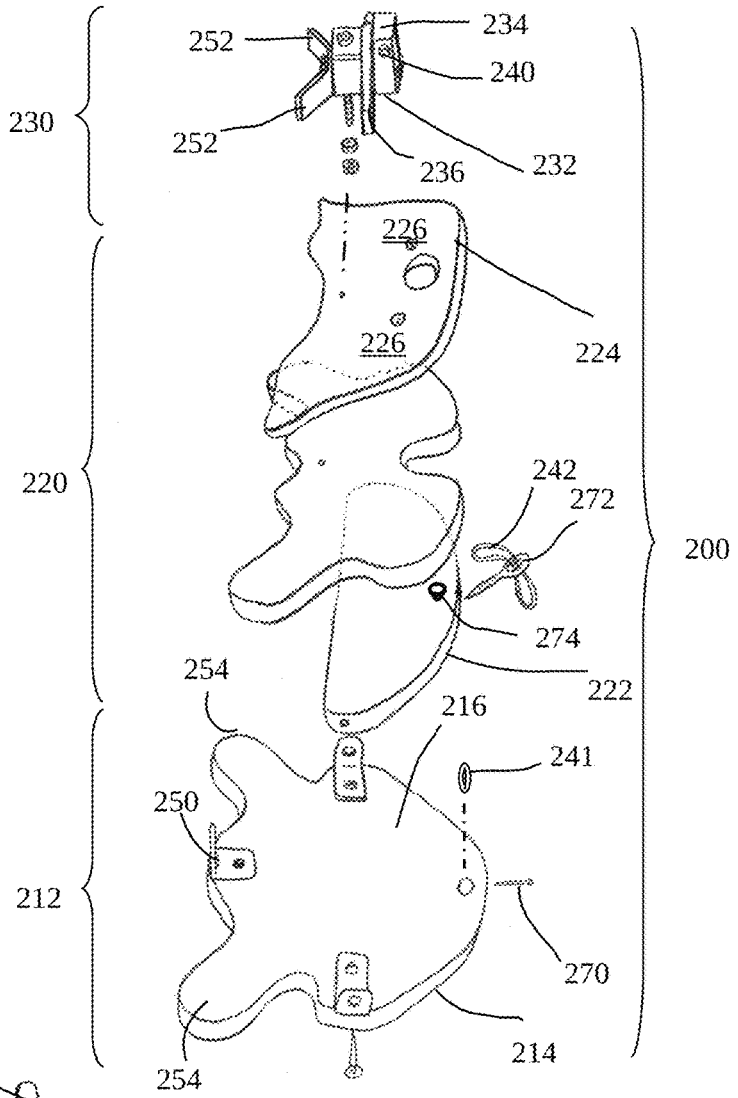
FIG. 8, in a right side exploded perspective view, illustrates the model hockey player of FIG. 2.

Referring, for example, to FIGS. 2, 4 and 8, in some embodiments of the invention, the model hockey player 200 further includes a pair of handles 254 extending laterally and at least partially rearwardly from opposed lateral edge portions of the player base component 212. Thus, the user may have a means for facilitating the positioning and holding stably in place the model hockey player 200 on the game board 400 so as to substantially precisely align the latter towards a predetermined opening of the model hockey goal 300. For example, the user uses one hand to position the player base component 212 and the other hand to control the pitch and move the player top portion 230 in the loading position. The angular movement towards the top position can be adjusted to provide more or less tension in the second elastic component 242, which in turn affects the speed at which the player top component moves when the model hockey puck 500 is hit, which correspondingly changes the speed at which the later flies off the resting surface 226.

In some embodiments, as exemplified in FIG. 8, the first and second elastic elements 241 and 242 can be each represented a suitably sized and configured loop or ring shaped elastic commonly found in office supply stores or the likes for easy replacement when needed. Also, as illustrated through FIGS. 4 to 8 collectively, and 21, the loop shaped first elastic element 241 has a lower end portion thereof removably engaged to the player base component 212 through a hole-and-lock pin arrangement 270, and an upper end portion thereof removably engaged around a screw eye 272 engaged centrally in a lower rearward portion of the player middle component 220.

Figure 21:
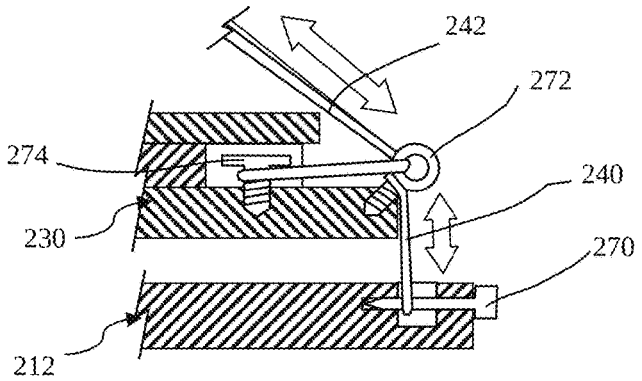
FIG. 21, in a partial side cutaway perspective view, illustrates first and second elastic elements engaged with a rearward portion of the model hockey player.
Figure 22:
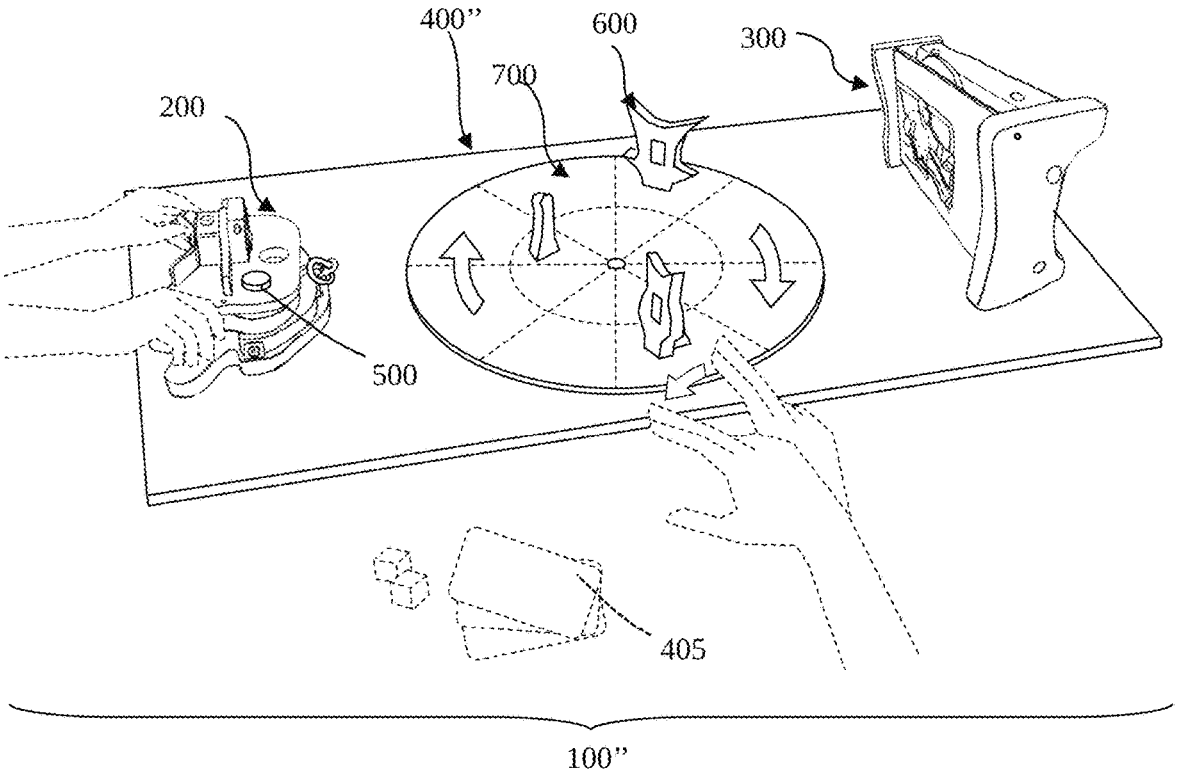
FIG. 22, in a perspective view, illustrates yet an other embodiment of a tabletop hockey game apparatus, according to the present invention.

Furthermore, as best illustrated in FIG. 21, the loop shaped second elastic element 242 has a lower portion thereof removably engaged around a screw head 274 engaged in a centrally disposed location of the player middle component 220 that is at least slightly spaced apart forwardly relative to the screw eye 272, an intermediate portion thereof extending through the screw eye 272, and an upper portion thereof removably engaged on a user selected one of the elastic engaging member 240 of the player top component 230. The thus elongated portion of the second elastic element 242 extending through the screw eye 272 allows the user to adjustably apply a substantially gradually expanding rotational swing to the player top component 230, resulting in a near natural slap-shot effect on the model hockey puck 500.

In some embodiments, as illustrated in FIG. 13, the rotatable disk 330 defines one disk recess 332 having a generally pie slice shape extending from a peripheral portion thereof and radially inwardly proximally the center of the rotatable disk 330. Also, each one in the at least one front plate element 334 defines three (3) front plate apertures 336, wherein the front plate apertures 336 and the disk recess 332 are suitably sized and configured such that the disk recess 332 may encompass partially at least two adjacent front plate apertures 336.

Figure 11:
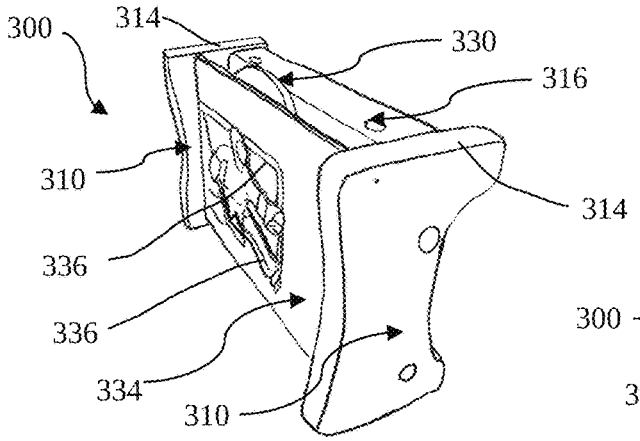
FIG. 11, in a front perspective view, illustrate a model hockey goal.
Figure 12:
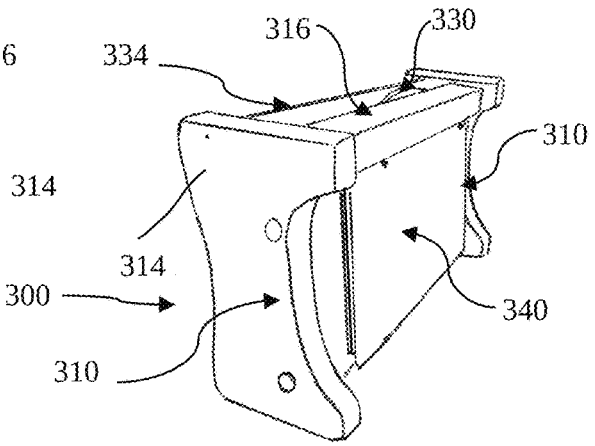
FIG. 12, in a rear perspective view, illustrate the model hockey goal of FIG. 11.

As best exemplified in FIGS. 1, 11 and 13, each of the three front plate apertures 336 may be defined to correspond, for example, to a selected contour outline within an illustration of a hockey goal frame, a typical hockey goalie figure, and an ice surface displayed on the forward most front plate element 334.

As illustrated in FIG. 13, the at least one front plate element 334 is freely suspended from the upper forward portion of the goal support frame 308 through a pair of horizontally and laterally distally extending front suspension pins 350 each engaged in a respective one in the pair of frame support members 310. The at least one rear plate element 340 is freely suspended from the upper rearward portion of the goal support frame 308 through a pair of horizontally and parallelly spaced apart rear suspension pins 352 extending longitudinally rearwardly from a centered upper edge portion of the frame plate element 316. It is important to note that other known means for freely suspending the front and rear plate members 334 and 340 are also possible.

In some embodiments, as illustrated in FIG. 13, the model hockey goal 300 includes two front plate elements 334, wherein the most distant front plate element 334 relative to the frame plate element 316 is made of a substantially rigid material, and the closest front plate element 334 relative to the frame plate element 316 is made of a resilient impact absorbing material.

The model hockey goal 300 may further include two rear plate elements 340, wherein the closest rear plate element 340 relative to the frame plate element 316 is made of a substantially rigid material, and the most distant rear plate element 340 relative to the frame plate element 316 is made of a resilient impact absorbing material. Thus, when the model hockey puck 500 directly impacts either the most distant front plate element 334 or the closest rear plate element 340, relative to the frame plate element 316, the impact sound and the rebound distance of the model hockey puck 500 resulting from the impact are each significantly attenuated compared to known tabletop model hockey goal assemblies of the prior art.

For example, the rigid material may be one of a rigid plastic, sheet metal or wood, or a combination thereof, and the resilient impact absorbing material may be foam or rubber. These impact absorbing characteristics of the model hockey goal 300 can be appreciated by the user or users of the tabletop hockey game apparatus 100 of the present invention because the risk of injury to the users, the risk of damaging delicate decoration items around the room where the game is played, and the effort to recuperate the model hockey puck 500 each time it has rebound after an impact, are all significantly attenuated. It is to be understood that the order of the freely suspended and spaced apart sheets of rigid and resilient impact absorbing materials, relative to the frame plate element 316 in the assembly of each one of the front and rear plate elements 334 and 336 respectively, may be inverted since the overall impact absorbing characteristics are substantially preserved in each case.

In some embodiments, as illustrated in FIGS. 1 and 20 collectively, the tabletop game board 400 or 400' has a substantially rectangular and planar configuration. The tabletop game board 400 or 400' includes distally opposed game board top and underside surfaces 410 and 412, longitudinal game board proximal and distal ends 402 and 404 relative to the user of the tabletop hockey game apparatus 100, and parallelly spaced apart lateral side edges 406.

Referring more particularly to FIG. 20, in an embodiment of the invention, the tabletop game board 400' further includes a recessed playing surface portion 420 defining a player surface boundary 422 there around. The recessed playing surface portion 420 extends laterally and longitudinally from a location substantially adjacent the game board proximal end 402 of the game board top surface 410, up to an intermediate location between the game board proximal end 402 and the game board distal end 404, and constitute a shooter positioning area over which the model hockey player 200 is selectively movable. Furthermore, the recessed playing surface portion 420 is covered with a metal sheet having a ferrous content.

In this embodiments, the model hockey player 200' further includes a magnetic element 260 rigidly connected centrally underside the player base component 212. Preferably, the magnetic element 260 has a substantially disk shaped configuration that is suitably sized for stably supporting and sufficiently elevating the underside of the player base component 212 such that only the periphery of the disk shaped magnetic element 260 contacts the player surface boundary 422.

Typically, the magnetic force of the magnetic element 260 is just sufficient to maintain the model hockey player 200 in contact with the recessed playing surface portion 420 when the game board 400 is tilted at an angle on one side that is slightly past the point where the model hockey player 200 would tip over on the side. Thus, competing users of the tabletop hockey game apparatus 100 may be allowed to move the model hockey player 200 within a strictly predetermined boundary of the game board 400 without possibility of bending the game rules in any one's favor. Furthermore, the game board 400 and model hockey player 200 engaged on the recessed playing surface portion 420 may be easily and rapidly moved from one table top to another without risking to damage the model hockey player 200.

Referring to FIGS. 17 to 20 inclusively, in some embodiments of the invention, the tabletop hockey game apparatus 100 or 100' further comprises at least one user selectively movable game board obstacle 600 positionable between the model hockey player 200 and model hockey goal 300. Each one of the at least one game board obstacle 600 may be represented by a single piece element, as exemplified in FIG. 19, or an assembly of two or more pieces, as exemplified in FIGS. 17 and 19.

The at least one game board obstacle 600 may be positioned at predetermined locations on the game board 400 or 400', for example, as specified by games rules indicated on random draw game cards 405, in cooperation with colored zones and/or boundary lines 602 traced on the surface of the game board 400 or 400'. Furthermore, the at least one game board obstacle 600 may have protruding portions 604 for raising the difficulty of suitably aiming the model hockey player towards the model hockey goal 300. The model hockey player 200 and model hockey goal 300 of the present invention may have all their structural components made of a sufficiently rigid material or combination of materials such as, for example, a polymeric material, a lightweight metal alloy or aluminum, or wood. Also, the model hockey puck 500, shown individually in FIG. 16, may be made of one of rubber, aluminum, a suitable metal alloy, a polymeric material, or a combination thereof.

In other embodiments, as seen in FIG. 22 for the tabletop hockey game apparatus 100", a turntable 700 is mounted to the game board 400" between the model hockey player 200 and model hockey goal 300. The game board obstacles 600 are positionable on the turntable 700, so that rotating the turntable can move the game board obstacles 600 either to a different static position, or dynamically by spinning the turntable 700. To that effect, the turntable 700 for example takes the form of a disk rotatably mounted to the game board 400" so as to be rotatable about is centre. In some embodiments, the turntable 700 and game board obstacles 600 are magnetically attracted to each other to maintain the position of the game board obstacles 600 over the turntable 700 even if the latter is vigorously spun. In other embodiments, the game board obstacles 600 include a means of mechanical coupling with the turntable 700, for example in the form of a pin insertable in a hole, among other possibilities. In yet other embodiments, the game board obstacles 600 are freely standing on the turntable 700.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

The invention claimed is:

1. A tabletop shooting game, comprising:

a projectile;

a shooter including a stand, an impactor and a biasing element, wherein;

the stand defines a resting surface for receiving the projectile thereonto;

the impactor defines an impact surface for contacting the projectile when the projectile is on the resting surface, the impactor being rotatably mounted to the stand so as to be movable between a hitting position wherein the impactor is operative for hitting the projectile with the latter operatively supported by the resting surface and a loading position wherein the impactor is retracted away from the resting surface; and the biasing element extends between the stand and the impactor so that the impactor is biased towards the hitting position when moved to the loading position; and a target;

a board on which the shooter and target are positionable;

wherein the shooter is operable for shooting the projectile towards the target by moving the impactor to the loading position with the projectile on the resting surface and subsequently releasing the impactor so that the impact surface projects the projectile due to the impactor hitting the projectile;

further wherein the board defines a shooter positioning area over which the shooter is selectively movable;

further wherein the resting surface is a first resting surface and the loading position is a first loading position, the stand defining a second resting surface, the first and second resting surfaces being laterally opposed to each other and operable for selectively receiving the projectile thereonto, and wherein the impactor is movable to a second loading position wherein the impactor is retracted away from the second resting surface.

2. The tabletop shooting game as defined in claim 1, wherein the stand includes a first portion positionable on the shooter positioning area and a second portion mounted to the first portion, the impactor being rotatably mounted to the second portion, the second portion being mounted to the first portion so as to be pivotable thereabout to vary a pitch of the second portion relative to the first portion.

3. The tabletop shooting game as defined in claim 2, wherein the shooter further includes a pitch indicator extending between the first and second portions, the pitch indicator including indicia indicative of the pitch.

4. The tabletop shooting game as defined in claim 2, wherein the shooter further includes another biasing element extending between the first and second portions for biasing the second portion towards a predetermined pitch relative to the first portion.

5. The tabletop shooting game as defined in claim 1, wherein the impactor defines two laterally opposed biasing element attachments, the biasing element having a free end selectively securable to each of the biasing element attachments for biasing the impactor towards the hitting position when in a respective one of the first and second loading positions.

6. The tabletop shooting game as defined in claim 1, wherein the target defines at least one target aperture configured and sized to allow the projectile to enter the target aperture.

7. The tabletop shooting game as defined in claim 6, wherein the target includes a resiliently deformable material positioned beyond the target apertures in a direction leading away from the shooter for absorbing at least part of a kinetic energy of the projectile after the projectile enters the target apertures.

8. The tabletop shooting game as defined in claim 1, wherein the target defines at least two target apertures configured and sized to allow the projectile to selectively enter each of the target apertures, the target further comprising a screen configured for selectively obstructing a first subset of the at least two target apertures while leaving unobstructed a second subset of the at least two target apertures.

9. The tabletop shooting game as defined in claim 8, wherein the screen includes a disk from which one or more portion has been removed, the disk being rotatable about a substantially horizontal axis, wherein rotating the disk changes which ones of the at least two target apertures are members of the first and second subsets.

10. The tabletop shooting game as defined in claim 1, wherein the shooter positioning area is recessed relative to adjacent portions of the board.

11. The tabletop shooting game as defined in claim 1, wherein the shooter and the board are magnetically attracted to each other over the shooter positioning area.

12. The tabletop shooting game as defined in claim 1, further comprising obstacles positionable between the shooter and the target.

13. The tabletop shooting game as defined in claim 12, further comprising a turntable onto which the obstacles are positionable, wherein rotating the turntable changes a relative position between the obstacles and the target.

14. The tabletop shooting game as defined in claim 1, further comprising game cards including instructions for providing selective restrictions on how the shooter and target are operated in a given round of the tabletop shooting game.

15. A tabletop shooting game, comprising:

a projectile;

a shooter including a stand, an impactor and a biasing element, wherein;

the stand defines a resting surface for receiving the projectile thereonto;

the impactor defines an impact surface for contacting the projectile when the projectile is on the resting surface, the impactor being rotatably mounted to the stand so as to be movable between a hitting position wherein the impactor is operative for hitting the projectile with the latter operatively supported by the resting surface and a loading position wherein the impactor is retracted away from the resting surface; and the biasing element extends between the stand and the impactor so that the impactor is biased towards the hitting position when moved to the loading position; and a target;

a board on which the shooter and target are positionable;

wherein the shooter is operable for shooting the projectile towards the target by moving the impactor to the loading position with the projectile on the resting surface and subsequently releasing the impactor so that the impact surface projects the projectile due to the impactor hitting the projectile;

further wherein the board defines a shooter positioning area over which the shooter is selectively movable;

further wherein the stand includes a first portion positionable on the shooter positioning area and a second portion mounted to the first portion, the impactor being rotatably mounted to the second portion, the second portion being mounted to the first portion so as to be pivotable thereabout to vary a pitch of the second portion relative to the first portion, the shooter further including a pitch indicator extending between the first and second portions, the pitch indicator including indicia indicative of the pitch.

16. A tabletop shooting game, comprising:

a projectile;

a shooter including a stand, an impactor and a biasing element, wherein;

the stand defines a resting surface for receiving the projectile thereonto;

the impactor defines an impact surface for contacting the projectile when the projectile is on the resting surface, the impactor being rotatably mounted to the stand so as to be movable between a hitting position wherein the impactor is operative for hitting the projectile with the latter operatively supported by the resting surface and a loading position wherein the impactor is retracted away from the resting surface; and the biasing element extends between the stand and the impactor so that the impactor is biased towards the hitting position when moved to the loading position; and a target;

a board on which the shooter and target are positionable;

wherein the shooter is operable for shooting the projectile towards the target by moving the impactor to the loading position with the projectile on the resting surface and subsequently releasing the impactor so that the impact surface projects the projectile due to the impactor hitting the projectile;

further wherein the board defines a shooter positioning area over which the shooter is selectively movable;

further wherein the target defines at least two target apertures configured and sized to allow the projectile to selectively enter each of the target apertures, the target further comprising a screen configured for selectively obstructing a first subset of the at least two target apertures while leaving unobstructed a second subset of the at least two target apertures.

17. The tabletop shooting game as defined in claim 16, wherein the screen includes a disk from which one or more portion has been removed, the disk being rotatable about a substantially horizontal axis, wherein rotating the disk changes which ones of the at least two target apertures are members of the first and second subsets.

* * * * *